US007113723B2

(12) United States Patent
Saito

(10) Patent No.: US 7,113,723 B2
(45) Date of Patent: Sep. 26, 2006

(54) IMAGE FORMING DEVICE FOR IMPROVED BELT CLEANING

(75) Inventor: Daisuke Saito, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 183 days.

(21) Appl. No.: 10/859,185

(22) Filed: Jun. 3, 2004

(65) Prior Publication Data

US 2005/0025518 A1 Feb. 3, 2005

(30) Foreign Application Priority Data

Jun. 23, 2003 (JP) ..... 2003-177726

(51) Int. Cl.
*G03G 15/16* (2006.01)

(52) U.S. Cl. ..... 399/101; 399/297

(58) Field of Classification Search ..... 399/101, 399/297, 298, 302, 308
See application file for complete search history.

(56) References Cited

U.S. PATENT DOCUMENTS 6,053,832 A 4/2000 Saito
6,389,255 B1 5/2002 Sawada et al.

FOREIGN PATENT DOCUMENTS

JP 8-106218 4/1996
JP 08305074 A * 11/1996
JP 10111582 A * 4/1998
JP 2002148866 A * 5/2002
JP 2003-202701 7/2003
JP 2003-228202 8/2003

* cited by examiner

*Primary Examiner*—David M. Gray
*Assistant Examiner*—Ryan Gleitz
(74) *Attorney, Agent, or Firm*—Oblon, Spivak, McClelland, Maier & Neustadt, P.C.

(57) ABSTRACT

An image forming device for preventing the lowering of the cleaning performance due to rolling up of the blade-like member, by reducing a force of rolling up both end parts of the blade-like member. The blade-like member is provided which presses the contact part extending in parallel in the axial direction of the support member against at least one support member with a belt-like member wound therearound and having the roller shape, with the belt-like member having an endless form interposed therebetween. Provision of tapered parts sloped with outer diameters reduced toward both end parts in the axial direction at both end parts in the axial direction of the one support member having a roller shape, makes the contact pressure of the contact parts at the blade-like member against the one support member having the roller shape, smaller at both end parts than at the central part in the axial direction of the support member.

8 Claims, 3 Drawing Sheets

IMAGE FORMING DEVICE FOR IMPROVED BELT CLEANING

BACKGROUND OF THE INVENTION

1. Field of the Invention

This invention relates to an image forming device capable of reducing a force of rolling up both ends of a blade-like member, and preventing lowering of cleaning performance due to the rolling up of the blade-like member.

2. Description of the Background Art

An image forming device of an electrophotographic system, for example, a copier, a facsimile device and a printer, equipped with an endless belt-like rotatable transferring/carrying belt, and a cleaning means for cleaning the transferring/carrying belt, besides a charging means, an exposing means and a developing means, is known.

In an image forming operation in such an image forming device, first, a latent image carrier is uniformly charged by the charging means, then an electrostatic latent image is formed on the latent image carrier by exposing the image by the exposing means. The electrostatic latent image is developed by the developing means to form a developed image, and the developed image on the latent image carrier is transferred to a recording medium carried by the transferring/carrying belt by a transferring/carrying means using the transferring/carrying belt in a transferring region wherein the latent image carrier faces the transferring/carrying belt. The recording medium having the developed image transferred thereon is carried to a fixing means to fix the developed image on the recording medium.

In such an image forming device, surplus toner seldom deposits on the transferring/carrying belt. The toner remaining on the latent image carrier, however, is sometimes transferred to the transferring/carrying belt, when the size of the recording medium does not coincide with the region of the toner image on the latent image carrier, or when a carrying jam of the recording medium occurs.

When the toner is deposited on the transferring/carrying belt, the toner on the transferring/carrying belt must be removed by cleaning the surface of the belt.

A cleaning device for removing the toner on the transferring/carrying belt by bringing the blade-like member in contact with the belt is generally used as the cleaning device for cleaning the transferring/carrying belt. The higher is the contact pressure of the blade-like member to the transferring/carrying belt, the higher becomes the cleaning performance to the belt.

A cleaning device for removing the toner on the transferring/carrying belt by bringing the blade-like member into contact with the belt from the counter direction, is disclosed, for example, in H2-034882 of the Japanese Patent Laid-Open Publications. In this cleaning device, as the blade-like member is brought into contact with the transferring/carrying belt from the counter direction, the contact pressure between the blade-like member and the belt becomes large. This has merit in that the cleaning performance to the belt is superior to that of a cleaning device where the blade-like member is brought into contact from a trailing direction.

When the blade-like member is continuously brought into contact with the endlessly moving belt, however, the part of the blade-like member in contact with the belt becomes soft by heat to be possibly rolled up. At the contact part of the blade-like member, in particular, both ends in the extending direction have a high degree of freedom of deformation to easily roll up compared to the central part of the contact part. Rolling up of both ends of the contact part triggers the rolling up of the central part of the blade-like member. The rolling up of the blade-like member thus causes various failures such as, lowering of the cleaning performance to contaminate the rear face of the recording medium, or increase of the load of driving the belt so as to break driving system.

Various failures as mentioned above due to the rolling up of the blade-like member can occur in cleaning belt-like members besides the transferring/carrying belt, and not limited to the case of cleaning the transferring/carrying belt. For example, a failure can also occur in the case of cleaning by bringing the blade-like member into contact with the belt-like member such as, a photoreceptor belt and an intermediate transferring/carrying belt used in the image forming device.

Technologies relating to the present invention are also disclosed in, e.g., Japan Patent Laid-Open Publication No. H08-106218, No. 2003-202701, and No. 2003-228202.

SUMMARY OF THE INVENTION

The object of the present invention is to provide an image forming device capable of reducing a force for rolling up both the ends of the blade-like member and preventing lowering of the cleaning performance due to the rolling up of the blade-like member.

In accordance with the present invention, there is provided an image forming device which comprises a photoreceptor, an endless type belt-like member wound around a plurality of support members at least one of them having a roller shape, with the outer periphery surface brought into contact with the above photoreceptor, a blade-like member having a contact part extending in parallel in the axial direction of the above support member, with the contact part pressed against the above one support member having the roller shape, and tapered parts provided on both end parts in the axial direction of the above one support member having the roller shape, and sloped to have reduced outer diameters toward both end parts in the axial direction.

In accordance with the present invention, there is also provided a copying device comprising an image inputting device for inputting image data and an image forming device for forming images on the basis of the image data inputted by the above image inputting device. The image forming device comprises a photoreceptor, a belt-like member having an endless form wound around a plurality of support members, at least one of which having a roller shape, with its outer periphery surface brought into contact with the above photoreceptor, a blade-like member having a contact part extending in parallel to the axial direction of the above support member, with the contact part pressed against the above one support member having a roller shape with the above belt-like member interposed therebetween, and tapered parts provided on both end parts in the axial direction of the above one support member having the roller shape, sloped with the outer diameters reduced toward both end parts in the axial direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(S)

The first embodiment of the present invention is explained as follows referring to FIGS. 1–4. The present embodiment relates to an example applied to the laser printer as an image forming device.

That is, the laser printer of the present embodiment is equipped with the printer engine provided on a path from a medium holding part (not shown in the figure) holding the recording medium before formation of the image to a medium ejecting part (not shown in the figure) ejecting the recording medium after formation of the image.

Figure 1:
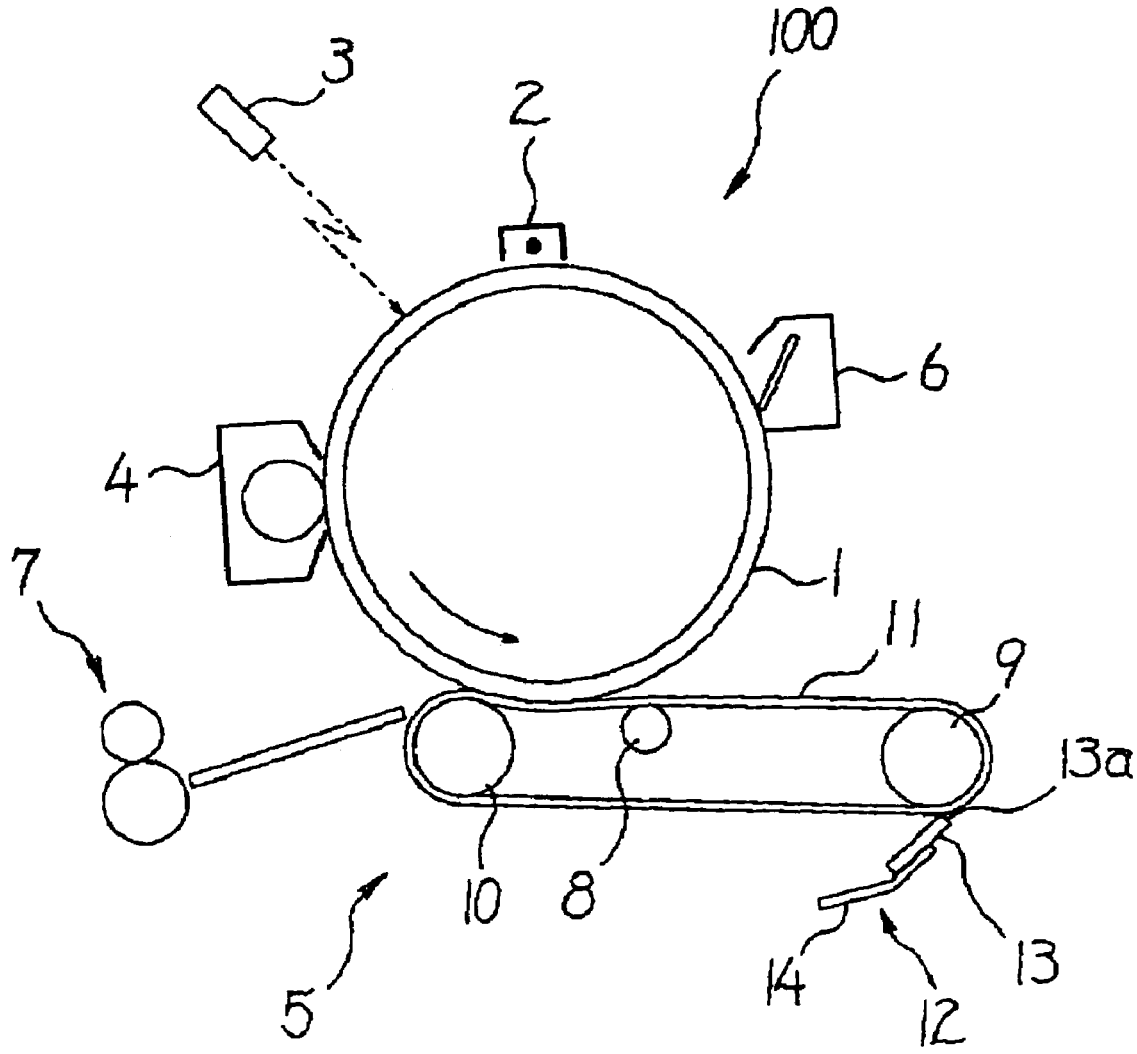
FIG. 1 shows an outline constitution of a printer engine provided in a laser printer related to the first embodiment of the present invention.

FIG. 1 shows an overview of the printer engine provided in the laser printer of the present embodiment. The printer engine 100 is composed of, as shown in the figure, a photoreceptor drum 1, the charging device 2, an exposure device 3, the developing device 4, transferring/carrying device 5, and a photoreceptor cleaning device 6.

The above charging device 2 is equipped with a charging roller contactingly disposed on the surface of the photoreceptor drum 1.

The above developing device 4, an explanation for which is omitted since it is a known art, holds the toner to be supplied to the surface of the photoreceptor drum 1 uniformly charged by the charging device 2. The toner held by the developing device 4 is supplied by a developing roller 4*a*. The developing device 4 holds the toner with an average roundness set in a range of 0.90–0.99, which is supplied to the surface of the photoreceptor drum 1. The toner used in the laser printer of the present embodiment has an average roundness set in a range of 0.93–0.97, and the toner containing 10% or less of the particles with a roundness less than 0.94 is further preferable.

Here, a measuring method of the roundness of the toner particles is explained.

In this embodiment, first a surfactant as a dispersant is added into 100–150 ml of water in a vessel with solid impurities eliminated in advance therefrom, and further a measuring sample is added.

Here, alkylbenzene sulfonate is preferably given as the surfactant. In the present embodiment, 0.1–0.5 ml of alkylbenzene sulfonate is added as the surfactant. About 0.1–0.5 g of the measuring sample is added.

Then, a suspension dispersed with the sample is set in an ultrasonic disperser to be treated for dispersion about 1–3 minutes therein. The concentration of the dispersion solution is set to be 3,000–10,000 particles/μl, and the shape and distribution of the toner particles are measured with a float type particle image analyzer, FPIA-2100 (a product of Toa Medical Electronics Co.). The roundness of the toner particles is obtained using the shape and distribution of the toner particles thus obtained.

Namely, in the present embodiment, the suspension containing toner particles is passed through an imaging part detecting zone on a plane, the toner form is measured using a method of an optical detecting zone for optically detecting and analyzing the image of the toner particles by a CCD camera, and the average roundness of the toner particles is obtained by dividing a circumferential length of an equivalent circle having the same projected area by a circumferential length of an actually existing particle.

The developing device 4 of the present embodiment holds the toner with a shape factor SF-1 set to 120–180, and a shape factor SF-2 set to 120–190, and the toner is supplied to the surface of the photoreceptor drum 1.

Here, the shape factors SF-1 and SF-2 of the toner are explained.

Figure 2:
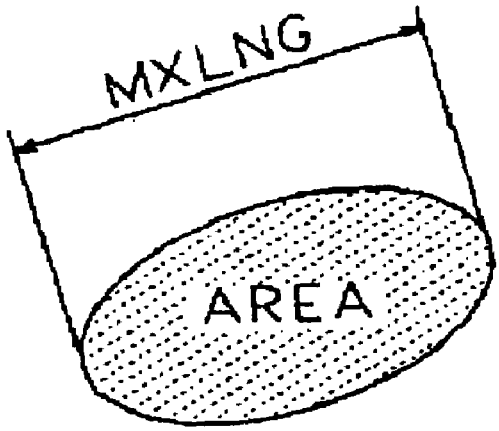
FIG. 2 is a drawing for explaining a shape factor SF-1.

The shape factor SF-1 is, as shown in FIG. 2, a value showing a ratio of the roundness of the shape of a spherical substance. The shape factor SF-1 is expressed as a value obtained by dividing a square of a maximum length MXLNG of an ellipsoidal figure formed by projecting the spherical substance on a two-dimensional plane, by the area AREA of the figure, then multiplied by 100π/4. Namely, the shape factor SF-1 is defined by equation (1) shown below:

$$SF\text{-}1=\{(MXLNG)^2/\mathrm{AREA}\}\times(100\pi/4) \qquad \text{Eq.(1)}$$

When the value of the SF-1 is 100, the shape of the substance is a real sphere. The larger the value of SF-1 is, the more amorphous the shape of the substance becomes.

Figure 3:
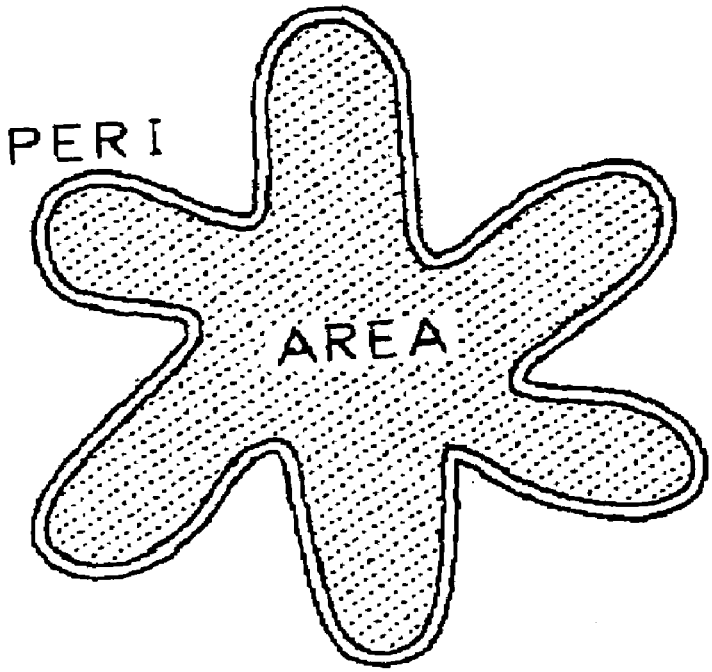
FIG. 3 is a drawing for explaining a shape factor SF-2.

The shape factor SF-2 is, as shown in FIG. 3, a value showing a ratio of irregularity of the shape of a substance. The shape factor SF-2 is expressed as a value obtained by dividing a square of the peripheral length PERI of a figure formed by projecting the substance on the two-dimensional plane, by the area AREA of the figure, then multiplied by 100/4π. Namely, the shape factor SF-2 is defined by equation (2) shown below:

$$SF\text{-}2=\{(PERI)^2/\mathrm{AREA}\}\times(100/4\pi) \qquad \text{Eq.(2)}$$

When the value of the SF-2 is 100, there is no irregularity on the surface of the substance. The larger the value of the SF-2 is, the more prominent the irregularity on the surface of the substance becomes.

In the present embodiment, the SF-1 and SF-2 are obtained using the above equations, by introducing the image information of the toner images sampled at random 100 times using FE-SEM (S-800), a product of Hitachi Works, into an analyzing apparatus (LUSEX3), a product of Nireco Co., and analyzing.

Analysis of the above shape factors, SF-1 and SF-2, makes clear that when the shape of the toner approaches limitlessly spherical (the SF-1 and SF-2 approach 100), the transfer efficiency rises. This is considered that, since the toner particles come into contact only in points with a substance (the toner particles themselves, the photoreceptor drum 1, etc.) coming into contact with the toner particles, fluidity of the toner is raised, or attracting force (mirroring force) to the photoreceptor drum 1 is weakened to be easily affected by transferring electric field.

When the shape of the toner comes close to a sphere, it turns disadvantageous to mechanical cleaning (blade cleaning). This is because, same as mentioned above, the fluidity of the toner is raised, or the attracting force (mirroring force) to the photoreceptor drum 1 is weakened, so that the toner easily passes through a fine gap between the cleaning member and the image carrier.

The shape of the toner, therefore, is preferably deformed (the value SF-1 becoming greater than 100) to some extent, or has irregularity (the value SF-2 becoming greater than 100) to some extent.

Further, the developing device 4 of the present embodiment holds toner having a ratio of a volume average particle size (μm) Dv to a number average particle size (μm) Dn, Dv/Dn, set to 1.05–1.30, and the toner is supplied to the surface of the photoreceptor drum 1.

Here, with dry toner having the volume average particle size (Dv) of 4–8 μm, and the ratio to the number average particle size (Dn), (Dv/Dn) of 1.05–1.30, preferably 1.10–1.25, the particle distribution of the toner becomes narrow, to cause the following merits:

1. Stable images can always be formed, since a phenomenon of selective development (the toner particles having a toner particle size corresponding to, or suitable to an image pattern, are selectively developed) hardly occurs.

2. Stable images can always be formed, being hardly affected by the above actions, as the toner particle distribution is originally narrow, even though a lot of toner particles with small sizes difficult to be transferred are recycled, when a toner recycling system is loaded.

3. With a binary developer, the variation of the toner particle size in the developer is little, even if the toner is repeatedly replenished over a long period, and a satisfactory and stable developing property is obtained, even if the toner is agitated for a long period in the developing device 4.

4. With one-component developer, even if the toner is replenished, the variation of the toner particle size is little, no filming of the toner to the developing roller 4*a* provided in the developing device 4 nor welding of the toner to the member such as the blade for thinning the toner is caused, and a satisfactory and stable developing property and images are obtained, even if the toner is agitated in the long period of use of the developing device.

In general, it is said that the smaller the particle size of the toner is, the more advantageous for obtaining high quality images with high resolution, while smaller toner particle size is disadvantageous for transferring property and cleaning property. In the case of the toner with a volume average particle size smaller than the range mentioned above, for example, with the binary developer, the toner is welded on the surface of the carrier in a long period of agitation, causing lowering of the charging capacity of the carrier, while with the one-component developer, filming of the toner to the developing roller 4*a*, or welding of the toner to members such as the blade (not shown in the figure) for thinning the toner is easily caused. These phenomena are also seen in toner with a content of fine particles larger than the range set in the present invention.

In the case of the toner with the particle size larger than the above-mentioned range, reversely, high quality images with high resolution are difficult to be obtained, and the variation of the particle size of the toner are often caused, when the toner is replenished into the developer. The ratio of the volume average particle size/number average particle size (Dv/Dn) larger than 1.30 is also found to cause the same phenomena.

The ratio of the volume average particle size/number average particle size (Dv/Dn) smaller than 1.05 presents a preferable aspect of stabilization of the behavior of the toner or uniformization of a charging amount. However, as functional separation by the toner particle size that thin line parts are developed by small-sized toner and solid images are developed mainly by large-sized particles is difficult to be performed, this state of the particles is not desirable.

Here, a measuring method for the particle size is explained.

In the present embodiment, an apparatus for particle size distribution measurement of the toner by Coulter counter method is used. As the apparatuses for particle size distribution measurement, Coulter counter TA-II and Coulter multisizer II are listed (products of Coulter Co.). A measuring method in the present embodiment is stated as below:

First, as a dispersing agent, 0.1–5 ml of a surfactant (preferably alkylbenzene sulfonate) is added to 100–150 ml of an aqueous electrolyte. Here, the electrolyte is an aqueous solution of NaCl of about 1% prepared by using first class sodium chloride, for example, ISOTON-II (a product Coulter Co.) can be used. Further, 2–20 mg of measuring sample is added to the solution.

Then, the electrolyte suspended with the measuring sample is treated for dispersion for 1–3 minutes in an ultrasonic disperser.

In the above measurement apparatus, by using an aperture of 100 μm as an aperture, the toner particle or volume and the number of the toner are measured to calculate the volume distribution and the number distribution. The volume average particle size (Dv) and the number average particle size (Dn) of the toner can be found from the distributions thus obtained. Explanations for the methods for obtaining the volume average particle size (Dv) and number average particle size (Dn) are omitted, since they are known arts.

As the channels, 13 channels of 2.00 or more and less than 2.52 μm; 2.52 or more and less than 3.17 μm; 3.17 or more and less than 4.00 μm; 4.00 or more and less than 5.04 μm; 5.04 or more and less than 6.35 μm; 6.35 or more and 8.00 μm; 8.00 or more and less than 10.08 μm; 10.08 or more and less than 12.70 μm; 12.70 or more and 16.00 μm; 16.00 or more and less than 20.20 μm; 20.20 or more and less than 25.40 μm; 25.40 or more and less than 32.00 μm; and 32.00 or more and less than 40.30 μm, are used, and particles with particle sizes 2.00 μm or more and less than 40.30 μm are set as the objects.

Next, the transferring/carrying device 5 is explained.

The transferring/carrying device 5 is equipped with a transferring/carrying belt 11 as a belt-like member. The transferring/carrying belt 11 is stretchedly wound around a transfer bias roller 8, a driving roller 9 and a driven roller 10, serving as a plurality of support members. In the present embodiment, the driving roller 9 realizes one support member having a roller form.

In the transferring/carrying belt 11, the stretched part between the transfer bias roller 8 and the driven roller 10 is press-contacted to the photoreceptor drum 1. As a result, a transfer nip is formed at the abutting point of the photoreceptor drum 1 with the transferring/carrying belt 11. The transfer bias roller 8 is located on a downstream side of the belt moving direction from the transfer nip, and imparts charge with a polarity reverse to the toner from the rear surface of the transferring/carrying belt 11.

A belt cleaning device 12 is provided at the lower side of the transferring/carrying belt 11 in the vicinity of the driving roller 9, for removing the toner and paper powder on the transferring/carrying belt 11. The belt cleaning device 12 is equipped with a cleaning blade 13 as a blade-like member and a holder 14 holding the cleaning blade 13. The blade-like member 13 has a contact part 13*a* extending in parallel in the axial direction of the driving roller 9, and is disposed in such a manner as to press the contact part 13*a* to the outer periphery surface of the driving roller 9 with the transferring/carrying belt 11 therebetween. The cleaning blade 13 is disposed in such a manner as to abut against the transferring/carrying belt 11 from the counter direction.

Figure 4:
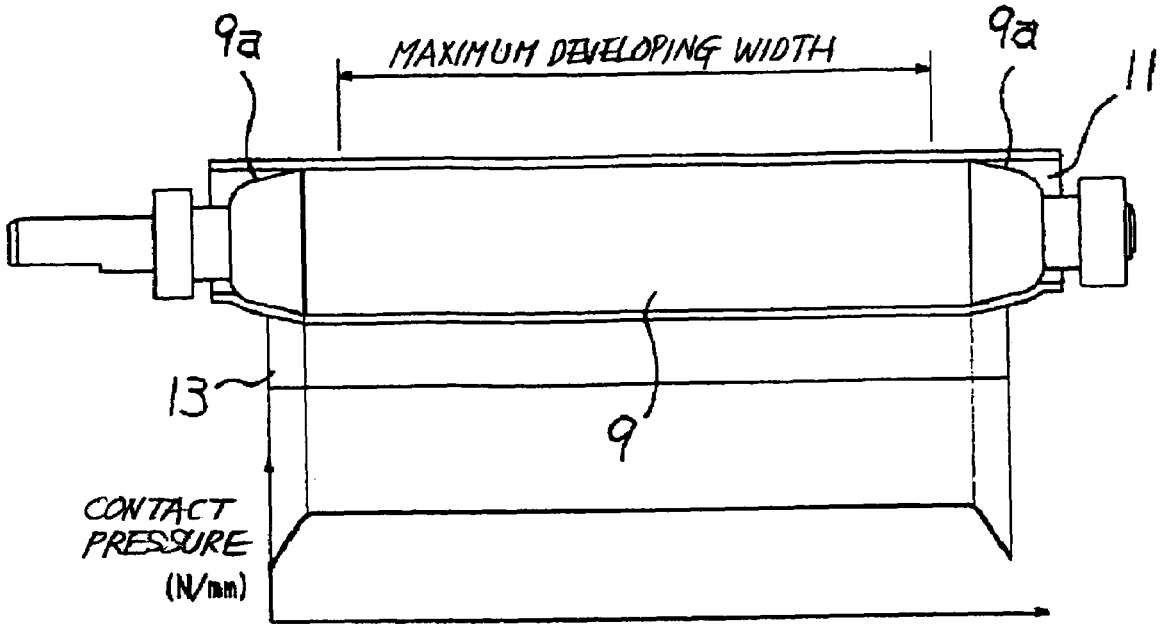
FIG. 4 is a partial cross-sectional drawing showing the state of the cleaning blade in contact with the surface of the transferring/carrying belt.

FIG. 4 shows a state of the cleaning blade 13 brought into contact with the surface of the transferring/carrying belt 11. In FIG. 4, a graph is additionally shown with the distance from one end in the extending direction of the contact part 13*a* of the cleaning blade 13 as the horizontal axis, and with the contact pressure (N/mm) per unit width between the transferring/carrying belt 11 and the cleaning belt 13. The cleaning blade 13 of the present embodiment, as shown in FIG. 4, is composed so that the contact pressure of the contact part 13*a* at both ends in the extending direction becomes smaller than the contact pressure at the central part in the extending direction of the contact part 13*a*.

Further actually, tapered parts 9*a* are provided so that the outer diameters thereof become reduced toward both the end parts in the axial direction of the driving roller 9. The contact pressure per unit width of the cleaning blade 13 pressed to the driving roller 9 by the tapered parts 9*a* via the transferring/carrying belt 11, is set smaller than the contact pressure at the central part in the axial direction of the cleaning blade 13.

The tapered parts 9*a* are provided on both end part sides in the axial direction from the maximum developing range in the axial direction of the driving roller 9 in the photoreceptive drum 1. Here, the maximum developing range in the axial direction of the driving roller 9 in the photoreceptor drum 1, means a dimensional range in the main scanning direction of images of the maximum size formable in the laser printer of the present embodiment.

The tapered parts 9*a* are tilted against the axial direction of the driving roller 9 to a degree of the driving roller 9 coming into contact with the transferring/carrying belt 11.

Further, the tapered parts 9*a* are tilted to such an extent that the contact range of the driving roller 9 with the transferring/carrying belt 11 is longer than the contact range of the contact part 13*a* in the cleaning blade 13 with the transferring/carrying belt 11 in the axial direction of the driving roller 9. As a result, the contact part 13*a* in the cleaning blade 13 comes in contact with the driving roller 9 over its whole region via the transferring/carrying belt 11.

In such an image forming operation in the laser printer, first, while rotating the photoreceptor drum 1 in the direction shown by an arrow A in the drawing, the surface of the photoreceptor drum 1 is charged uniformly by the charging device 2. Thereafter, the surface of the photoreceptor drum 1 is scanned and exposed by the exposure device 3 on the basis of the image information, to form electrostatic latent images on the surface of the photoreceptor drum 1. Then, the electrostatic latent images are developed by the toner to form the toner images at the portion facing the developing device 4.

While, a recording medium is fed from a feeding device (not shown in the figure) to a register roller 7, in response to the timing of the above operation in the printer engine 100. The recording medium is sent from the register roller 7 corresponding with the toner images on the photoreceptor drum 1, and is carried by the transferring/carrying belt 11.

The toner images on the photoreceptor drum 1 are transferred to the recording medium sent out of the register roller 7 at a prescribed timing, at a position facing the transferring/carrying device 5. The recording medium with the toner images transferred thereto is, thereafter, carried to a fixing device (not shown in the figure), the toner images are fixed by the fixing device and ejected to an ejecting part.

After the toner images are transferred to the recording medium, the residual toner on the photoreceptor drum 1 is removed by a photoreceptor cleaning device 6 to prepare for the next image forming operation.

In some cases, in such a laser printer, the size of the toner images on the photoreceptor drum 1 does not coincide with that of the recording medium, for example, due to an undefined size of the recording medium, or the toner images on the photoreceptor drum 1 are transferred to the transferring/carrying belt 11, since the recording medium cannot reach a transfer nip due to occurrence of recording medium jam. In the laser printer, a minute amount of the toner sometimes deposits on a non-image part on the photoreceptor drum 1, and such toner sometimes transferred to the transferring/carrying belt 11.

The toner or other foreign matter remaining on the transferring/carrying belt 11 after the separation of the recording medium from the belt 11, must be removed for each image forming operation, since it causes various failures, like deterioration of the image quality, as seen above.

In the laser printer of the present embodiment, the foreign matter like the remaining toner is removed by the belt cleaning device 12. Actually, as the belt cleaning device 12 is equipped with the belt cleaning blade 13 abutting on the transferring/carrying belt 11 from the counter direction against the rotation direction of the belt 11, the rotation of the transferring/carrying belt 11 causes rubbing of the belt 11 by the contact part 13*a* of the cleaning blade 13, removing the foreign matter like the remaining toner.

In the cleaning device 12 for removing the foreign matter like remaining toner on the belt 11, however, as the cleaning blade 13 abuts on the belt 11 from the counter direction, the cleaning blade 13 can be rolled up due to softening of the cleaning blade 13 by heat, when the belt 11 is continuously moving. In particular, both end parts of the contact parts 13*a* in the extending direction of the cleaning blade 13 are free ends, having a large deformation degree of freedom. This structural factor causes easier rolling up of both end parts compared to the central part.

The rolling up occurring at both end parts in the extending direction of the contact part 13*a* of the cleaning blade 13 propagates to the central part of the cleaning blade 13.

Thereby, in a conventional image forming device having a cleaning blade abutting on the transferring/carrying belt 11, lowering of the cleaning performance occurs due to the cleaning blade by continuous image formation operation, causing rear side contamination of the recording medium. A failure of breakage of the driving system can be caused due to an increase of the driving load for driving the belt 11.

The laser printer of the present embodiment, on the other hand, is equipped with the photoreceptor drum 1 as a photoreceptor; the transferring/carrying belt 11 as a belt-like member having an endless form which is wound around the transfer bias roller 8, driving roller 9 and driven roller 10 serving as a plurality of support members, with the outer surface brought into contact with the photoreceptor drum 1; the cleaning blade 13 as a blade-like member, having the contact part 13*a* extending in parallel to the axial direction of the driving roller 9 as the support members at least one of which having a roller shape, and pressing the contact part 13*a* to the driving roller 9 with the belt 11 therebetween; the tapered parts 9*a* provided on both end parts in the axial direction of the driving roller, sloped to have smaller outer diameters toward both ends in the axial direction. This configuration reduces the contact pressure of the contact part 13*a* of the cleaning blade 13 against the driving roller 9 at the end parts compared to that at the central part in the axial direction of the driving roller 9, to reduce a rolling up force of the cleaning blade 13 at both end parts of the cleaning blade 13 in the axial direction of the driving roller 9, and to prevent the lowering of the cleaning performance due to rolling up of the cleaning blade 13.

In the laser printer of the present embodiment, as the tapered parts 9*a* are provided at end part sides beyond the maximum developing range in the axial direction of the driving roller 9 in the photoreceptor drum 1. The contact part

13*a* in the cleaning blade 13 thereby comes into contact with the transferring/carrying belt 11 over the whole developing range in the photoreceptor drum 1. This secures the cleaning performance by the cleaning blade 13 over the whole developing range in the photoreceptor drum 1, or over the whole range for carrying the images formed on the photoreceptor drum 1 in the transferring/carrying belt 11, to prevent cleaning failure over the whole image carrying range.

Further, in the laser printer of the present embodiment, as the tapered parts 9*a* are sloped in relation to the axial direction of the driving roller 9, to the extent of the driving roller 9 coming into contact with the transferring/carrying belt 11, the contact between the driving roller 9 and the belt 11 is secured even at the tapered parts 9*a*. Therefore, the cleaning performance by the cleaning blade 13 can be secured even at the tapered parts 9*a* to prevent cleaning failure due to the provision of the tapered parts 9*a*.

Besides, in the laser printer of the present embodiment, as the tapered parts 9*a* are sloped to the extent that the contact range of the driving roller 9 with the transferring/carrying belt 11 is longer than that of the contact parts 13*a* of the cleaning blade 13 with the belt 11 in the axial direction of the of the driving roller 9, the contact parts 13*a* of the cleaning blade 13 stably abut on the belt 11 over the whole range of the contact parts 13*a* of the cleaning blade 13. Therefore, by providing the tapered parts 9*a*, for example, the contact between the driving roller 9 and the belt 11 is not kept at both end part sides in the axial direction of the driving roller 9, and even if the end parts of the belt are set free, the cleaning performance at the cleaning target position by the blade member can be secured without being affected by the behavior of the freed belt 11, to prevent the cleaning failure due to the provision of the tapered parts 9*a*.

In an image forming device employing a cleaning device for removing remaining toner on the transferring/carrying belt 11 by the cleaning blade 13, like the laser printer of the present embodiment, it is known that when the average roundness of the toner particles is larger than 0.99, the cleaning failure on the photoreceptor and transfer belt occurs, to cause contamination on the images.

Such a cleaning failure is liable to occur, when outputting images with a high image area ratio, such as a color photograph image, and when untransferred images remain on the photoreceptor due to paper feeding failure.

In the laser printer as in the present embodiment, having the charger 2 provided with the charging roller for contact-charging the photoreceptor drum 1, frequent cleaning failures like this promote contamination of the charging roller in contact with the photoreceptor drum 1, and prevent the exertion of the charging capacity originally owned by the charging roller. Such a cleaning failure, however, seldom causes a problem in the case of little remaining toner such as when outputting images with a low image area ratio.

For this, as in the laser printer of the present embodiment, by setting the average roundness of the toner held by the developing device in the range of 0.90–0.99, the toner concentration can be properly set to effectively form images with satisfactory reproducibility and high fineness. In particular, the toner with an average roundness of 0.93–0.97, and with the particles of the roundness less than 0.94 set less than 10%, is further preferable from the point of proper setting of the toner concentration, good reproducibility and forming effectively images of high fineness.

The undefined toner far from spherical form cannot provide satisfactory transferring property nor high quality images without dust.

For this, by stipulating the form of the toner particles (average roundness) as in the present embodiment, the transferring property can be improved and high quality images without dust can be obtained.

Even if toner particles satisfying a prescribed form are contained, satisfactory transferring property or high quality image sometimes cannot be obtained, depending on the distribution state of the toner particles of this form. For this, by setting the content of the particles with a roundness less than 0.94, to 10% or less, the transferring property can be improved, and high quality images without dust can be obtained.

It is known that in a system employing the blade cleaning, in the case of an average roundness exceeding 0.99, cleaning failure on the photoreceptor and the transfer belt occurs, so as to cause contamination on the images.

As seen above, in the laser printer of the present embodiment, by providing the developing device 4 for feeding the toner to the surface of the photosensitor drum 1, and by stipulating the average roundness of the toner for feeding the toner set to the average roundness of 0.90–0.99 by the developing device 4, the cleaning failure can be further effectively prevented.

In this laser printer of the present embodiment, the developing device is provided for feeding the toner to the surface of the photoreceptor drum 1, and the developing device can further effectively prevent the cleaning failure by stipulating the toner shape factors SF-1 and SF-2 for feeding the toner with the shape factors SF-1 and SF-2 set to 120–180, and 120–190, respectively.

In the laser printer of the present embodiment, the developing device is provided for feeding the toner to the surface of the photoreceptor drum 1, and the developing device feeds the toner with a ratio of the volume average particle size Dv (μm) to the number average particle size Dn (μm), Dv/Dn, set to 1.05–1.30. By stipulating the ratio of the volume average particle size Dv (μm) to the number average particle size Dn (μm), Dv/Dn, therefore, the cleaning failure can be further effectively prevented.

Next, the second embodiment of the present invention is explained. This embodiment relates to an application example of an image forming device to a copying device of a digital system, therefore, the same parts as those of the first embodiment are shown by the same marks, and the explanation is omitted.

Figure 5:
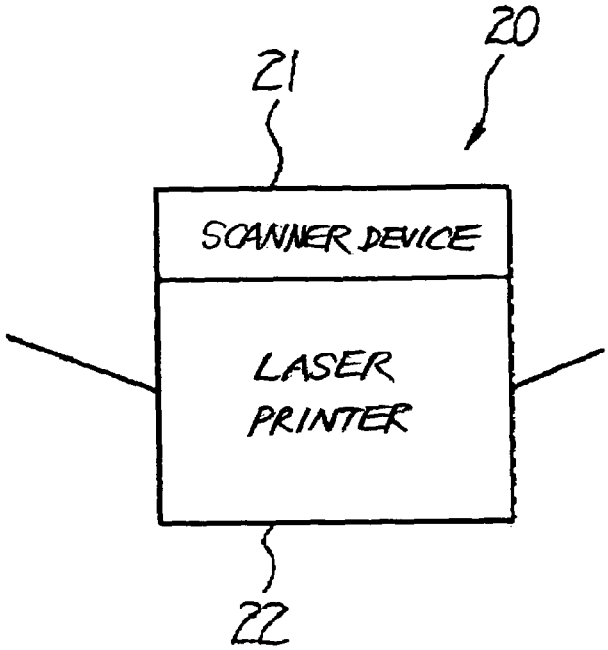
FIG. 5 shows an outline construction of a copier related to the second embodiment of the present invention.

FIG. 5 shows the outline of the copying device of the second embodiment. As shown in the drawing, the copying device 20 is provided with a scanner device 21 serving as an image input device for reading original images optically, and a laser printer 22 serving as an image forming device for image forming on the basis of the image data read by the scanner device.

The figures and an explanation thereof of the foregoing are omitted as this is a known art. The scanner device 21 is provided with a reading optical system capable of optically reading the original images placed on a contact glass. The reading optical system is provided with a scanning optical system for exposing-scanning the original images placed on the contact glass or photoelectric transfer elements for forming the digital image data on the basis of exposing-scanning light by the scanning optical system.

The laser printer 22 is provided with the printer engine 100 of the above first embodiment. The printer engine 100 performs image forming operation on the basis of the image data formed by the scanner device.

This copying device of the present embodiment, as seen above, can prevent the lowering of the cleaning performance caused by rolling up of the cleaning blade 13, to form images with satisfactory quality.

The image forming device of the present invention has the following characteristics:

(1) As the contact pressure at the contact part of the blade-like member to the one support member of a roller shape, is smaller at both end parts than at the central part in the axial direction of the support member, the rolling up force of the blade-like member can be reduced at both end parts of the blade-like member in the axial direction of the support member, thereby to prevent lowering of the cleaning performance due to the rolling up of the blade-like member;

(2) As the contact part of the blade-like member comes into contact with the belt-like member over the whole developing range, the cleaning performance by the blade-like member can be secured over the whole range of the developing range of the photoreceptor, that is, over the whole region of carrying the images formed by the photoreceptor in the belt-like member (image carrying region), to prevent the cleaning failure over the whole range of the image carrying region;

(3) In the tapered parts, also, as the contact of the one support member of a roller shape with the belt-like member can be maintained, the cleaning performance by the blade-like member can be secured at the tapered parts also, to prevent the cleaning failure due to the provision of the tapered parts;

(4) As the contact part in the blade-like member stably abuts on the belt-like member over the whole range of the contact part of the blade-like member, by providing tapered parts, for example, the contact of the support member at both end parts in the axial direction of the one support member of a roller shape, with the belt-like member cannot be maintained. Thereby the cleaning performance, can be secured at the position to be cleaned by the blade-like member, without being affected by the behavior of the freed belt-like member, even if the end part of the belt-like member is freed, to prevent the cleaning failure due to the provision of the tapered parts;

(5) Stipulation of the average roundness of the toner can further effectively prevent the cleaning failure;

(6) Stipulation of the toner shape factors SF-1 and SF-2 can further effectively prevent the cleaning failure;

(7) Stipulation of the ratio of the volume average particle size Dv (μm) to the number average particle size Dn (μm), Dv/Dn, can further effectively prevent the cleaning failure.

Various modifications will be possible for those skilled in the art after receiving the teachings of the present disclosure without departing from the scope thereof.

What is claimed is:

1. An image forming device comprising:

a photoreceptor;

an endless type belt-like member wound around a plurality of support members at least one of them having a roller shape, with the outer periphery surface brought into contact with said photoreceptor;

a blade-like member having a contact part extending in parallel in the axial direction of said at least one support member, with the contact part pressed against said at least one support member having the roller shape; and tapered parts provided on both end parts in the axial direction of the said at least one support member having the roller shape, and sloped to have reduced outer diameters toward both end parts in the axial direction, said blade-like member extending axially beyond said tapered parts of said at least one support member so as to apply a substantially constant pressure to said belt member in an area of said belt member which is between said tapered parts of said end parts of said at least one support member.

2. An image forming device as claimed in claim 1, wherein the above tapered parts are provided at both end part sides in the axial direction from the maximum developing range in the axial direction of said at least one support member having the roller shape in the above photoreceptor.

3. An image forming device as claimed in claim 1, wherein the above tapered parts are sloped in relation to the axial direction of the said at least one support member having the roller shape, to the extent of said at least one support member having the roller shape coming into contact with the above belt-like member.

4. An image forming device as claimed in claim 1, wherein the above tapered parts are sloped to such an extent that the contact range of the above one support member having the roller shape with the above belt-like member is longer than the contact range of the above contact part in the above blade-like member with the above belt-like member in the axial direction of said at least one support member having the roller shape.

5. An image forming device as claimed in claim 1, further comprising the developing device for feeding the toner to the above photoreceptor surface, the above developing device feeding the toner with the average roundness set to 0.90–0.99.

6. An image forming device as claimed in claim 1, further comprising the developing device for feeding the toner to the above photoreceptor surface, the above developing device feeding the toner with the shape factors SF-1 and SF-2 set to 120–180, and 120–190, respectively.

7. An image forming device as claimed in claim 1, further comprising the developing device for feeding the toner to the above photoreceptor surface, the above developing device feeding the toner with a ratio of the volume average particle size Dv (μm) to the number average particle size Dn (μm), Dv/Dn, set to 1.05–1.30.

8. A copying device comprising an image inputting device for inputting image data; and an image forming device for forming images on the basis of the image data inputted by the above image inputting device, the image forming device comprising:

a photoreceptor;

a belt-like member having an endless form wound around a plurality of support members, at least one of which having a roller shape, with its outer periphery surface brought into contact with the above photoreceptor;

a blade-like member having a contact part extending in parallel to the axial direction of the above support member, with the contact part pressed against said at least one support member having a roller shape with the above belt-like member interposed therebetween; and tapered parts provided on both end parts in the axial direction of said at least one support member having the roller shape, sloped with the outer diameters reduced toward both end parts in the axial direction, said blade-like member extending axially beyond said tapered parts of said at least one support member so as to apply a substantially constant pressure to said belt member in an area of said belt member which is between the said tapered parts of said end parts of said at least one support member.

* * * * *